US006360451B1

(12) United States Patent
Hanig

(10) Patent No.: US 6,360,451 B1
(45) Date of Patent: Mar. 26, 2002

(54) CROSSOVER GRAIN CONDUITS FOR STACK DRYERS

(75) Inventor: John A. Hanig, Sheffield, IA (US)

(73) Assignee: Sukup Manufacturing Company, Sheffield, IA (US)

( * ) Notice: Subject to any disclaimer, the term of this patent is extended or adjusted under 35 U.S.C. 154(b) by 0 days.

(21) Appl. No.: 09/588,843

(22) Filed: Jun. 7, 2000

(51) Int. Cl.[7] ..... F26B 17/12
(52) U.S. Cl. ..... 34/168; 34/167; 34/506
(58) Field of Search ..... 34/165, 166, 167, 34/168, 169, 170, 171, 172, 173, 174, 176

(56) References Cited

U.S. PATENT DOCUMENTS

| | | | | | |
|---|---|---|---|---|---|
| 3,406,463 | A | * | 10/1968 | Andersen | 34/574 |
| 3,526,969 | A | * | 9/1970 | Alms et al. | 34/574 |
| 3,735,498 | A | * | 5/1973 | Suzukawa et al. | 34/10 |
| 3,751,824 | A | | 8/1973 | Kyle | 34/167 |
| 3,869,809 | A | * | 3/1975 | Keirn | 34/174 |
| 4,242,806 | A | * | 1/1981 | McClaren | 34/13 |
| 4,411,620 | A | * | 10/1983 | Applegate | 432/29 |
| 5,467,535 | A | | 11/1995 | Lentz | 34/168 |
| 5,992,044 | A | | 11/1999 | Hanig | 34/434 |
| 6,035,544 | A | * | 3/2000 | Morrison et al. | 34/167 |

OTHER PUBLICATIONS

Berico "Rice Driers", A division of Behlen Mfg. Co., Box 569, Columbus, NE 68601.

* cited by examiner

*Primary Examiner*—Denise L. Esquivel
*Assistant Examiner*—Greg T. Warder
(74) *Attorney, Agent, or Firm*—Zarley, McKee, Thomte, Voorhees & Sease PLC

(57) ABSTRACT

The grain dryer of the present invention has upper and lower heat plenums, with first and second grain conduits, with each conduit having an upper section and a lower section, and a central crossover section between the upper and lower sections. The upper section of each conduit is on one side of the upper heat plenum, while the lower section of each conduit is on the opposite side of the lower heat plenum. The crossover sections of each conduit extend the respective conduits from one side of the upper heat plenum to the opposite side of the lower heat plenum.

9 Claims, 4 Drawing Sheets

CROSSOVER GRAIN CONDUITS FOR STACK DRYERS

BACKGROUND OF THE INVENTION

Existing grain dryers typically utilize a plurality of polygonal-shaped grain conduits with a longitudinal central opening defining a heat plenum through which hot air is driven by a fan. At least the inner walls of the conduits that define the heat plenum are perforated to permit the air to pass therethrough to dry the grain within the conduits. The grain is introduced at the top of the dryer into the conduits and moves by gravity downwardly through the conduits for discharge at the bottom of the dryer.

It is known to stack such dryer units one on top of another in a double or triple stack. In such stack dryers, the conduits extend down opposite sides of the dryers from the top of the upper-most dryer unit to the bottom of the lowered dryer unit. In such stack dryers, the grain adjacent the inside wall of the conduit in closest proximity to the heat plenums becomes over dried and damaged, while grain adjacent the outer walls of the conduits furthest from the heat plenums may not be sufficiently dried. Thus, a non-uniform quality of grain dryness results.

Also, environmental factors such as wind can have a drastic effect on the moisture content of the grain in a stack grain dryer. Winds of 10–20 miles per hour can substantially reduce the drying efficiency of the dryer, such that grain on the exposed side is not as dry as grain on the opposite side, which is protected from the wind.

Prior art dryers have also attempted to increase uniformity of drying by providing internal deflectors or vanes which direct the grain between opposite walls. The Kyle U.S. Pat. No. 3,751,824 discloses such a dryer having internal deflector chutes for inverting the grain flow within each side of the dryer. However, such internal walls or deflectors are subject to plugging due to material or debris catching on the internal conduit structure.

Therefore, a primary objective of the present invention is the provision of an improved stack dryer for drying grain.

Another objective of the present invention is the provision of a stack grain dryer having crossover grain conduits so as to provide improved uniformity of drying of the grain.

Another objective of the present invention is the provision of an improved stack dryer for grain wherein the grain conduits crossover between the upper and lower dryer units so as to expose different portions of the grain to the highest heat intensity from the heat plenums.

A further objective of the present invention is the provision of an improved stack dryer for grain wherein the grain is moved from one side of the dryer to the opposite side of the dryer so as to minimize adverse effects of wind on grain drying.

Another objective of the present invention is the provision of an improved method of drying grain in a stack grain dryer.

These and other objectives will become apparent from the following description of the invention.

SUMMARY OF THE INVENTION

A stack grain dryer is provided with upper and lower dryer units with grain conduits extending along each side of the central heat plenums. Each conduit has an upper section and a lower section, with an intermediate crossover section, such that the upper sections of the conduits extend along one side of the upper heat plenum and the lower sections of the conduits extend along the opposite side of the lower heat plenum. Thus, the grain flowing along the inner wall of the upper conduit section flows along the outer wall of the lower conduit section. Similarly, the grain flowing along the outer wall of the upper conduit sections flows along the inner wall of the lower conduit section. By moving the grain from one side of the dryer to the opposite side of the dryer during the drying process, via the crossover conduits, the grain is protected from the wind for approximately one-half of the drying process, thereby balancing moisture content of the grain on both sides of the dryer. Accordingly, improved uniformity of grain dryness is achieved with the crossover conduits of the stack dryer.

DETAILED DESCRIPTION OF THE DRAWINGS

Figure 1:
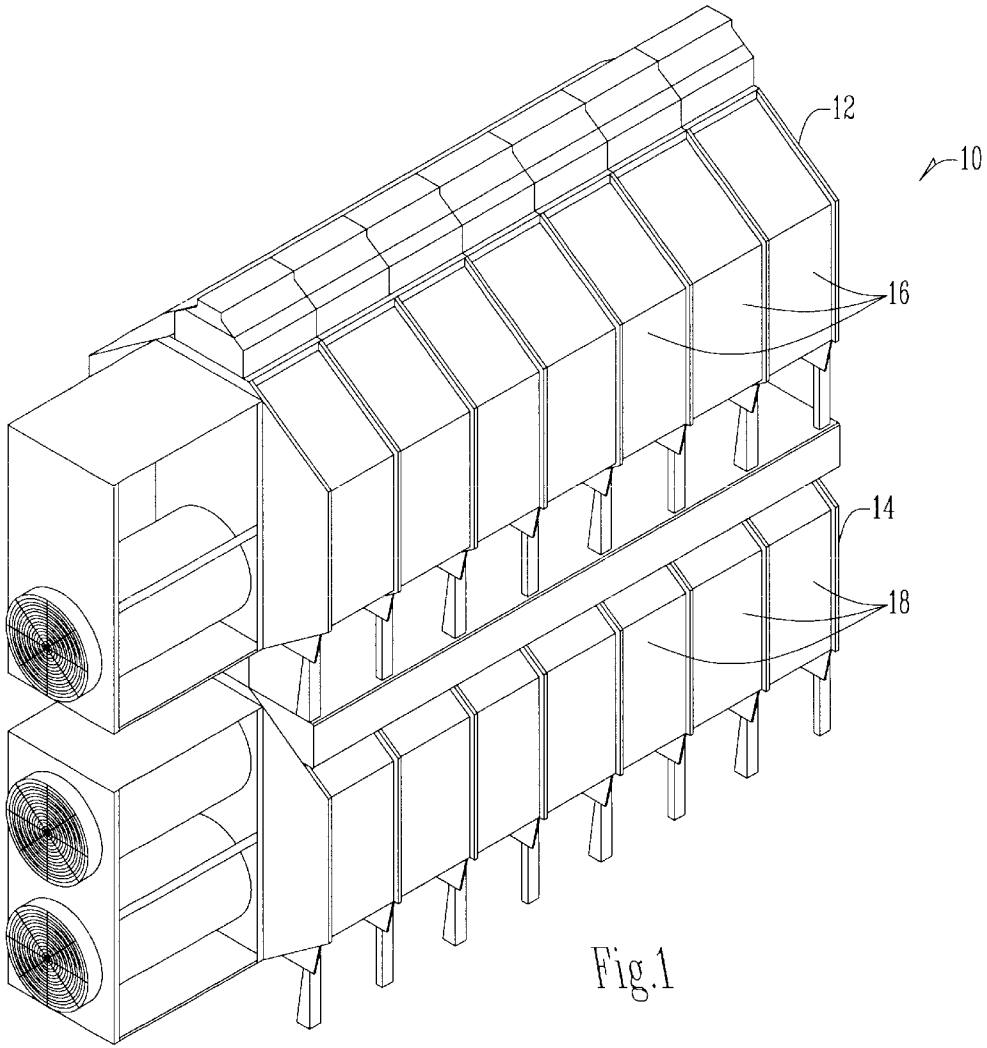
FIG. 1 is a perspective view of a stack dryer for drying grain.

A stack dryer is generally designated in FIG. 1 by the reference numeral 10. The dryer 10 includes an upper dryer unit 12 and a lower dryer unit 14. If desired, another dryer unit can be stacked on top of unit 12. The upper dryer unit 12 includes a plurality of longitudinally arranged upper grain conduits 16. The lower dryer unit 14 includes a plurality of longitudinally arranged lower grain conduits 18. The conduits 16, 18 define upper and lower heat plenums 20, 22 respectively, which extend along the length of the dryer units 12, 14. Each upper and lower dryer unit 12, 14 also includes at least one heater and fan assembly 24, adapted to force hot air into the heat plenums 20, 22, respectively.

The above construction of the stack dryer 10 is conventional, and does not constitute a part of the present invention.

Figure 2:
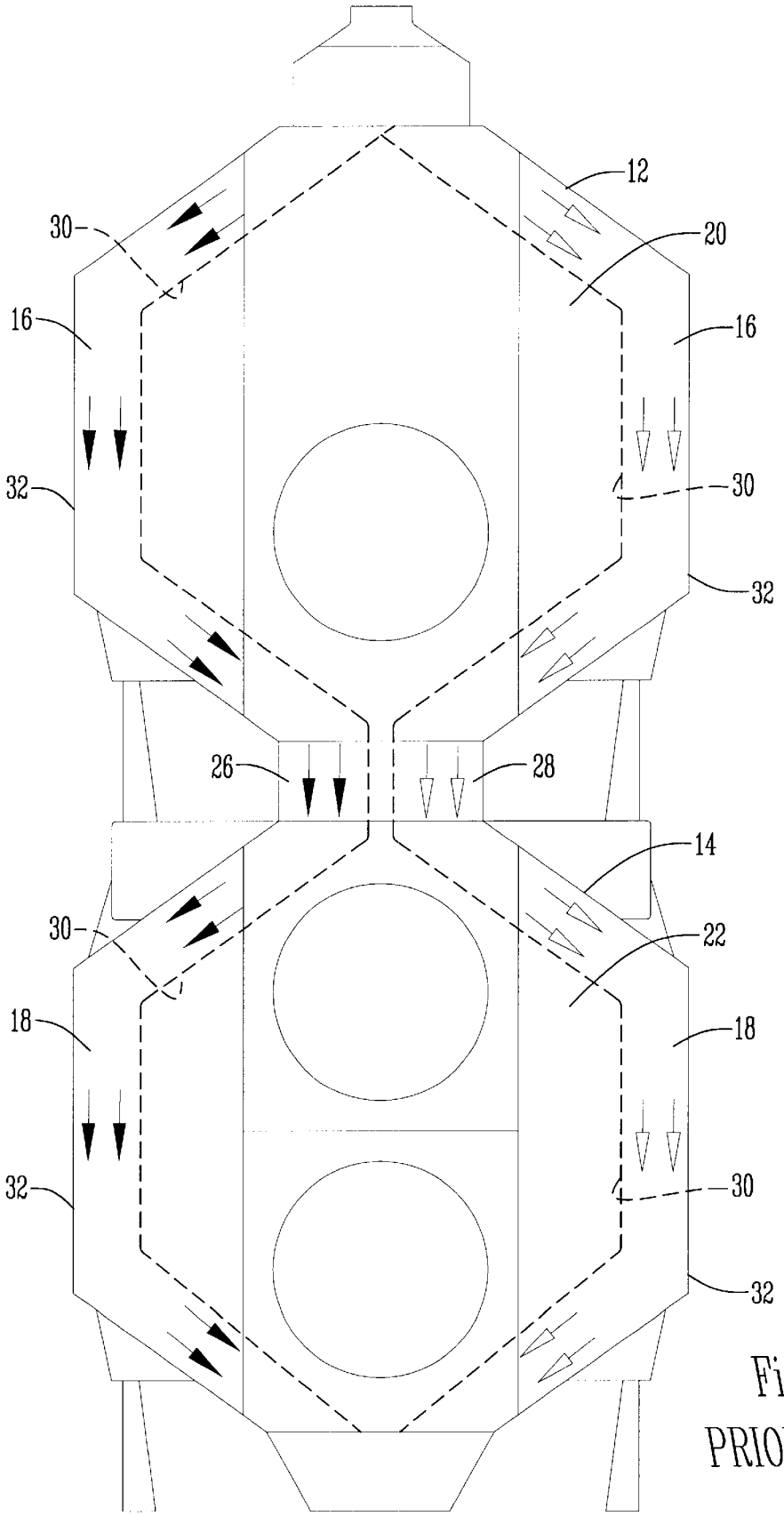
Fig.2 PRIOR ART
FIG. 2 is a sectional view showing the conduits of the prior art stack dryer.

In the prior art, as shown in FIG. 2 and as viewed from an end of the stack dryer 10, the conduits 16, 18 include left hand and right hand sections with a transition section 26 which connects the upper and lower left hand conduits and a transition conduit section 28 which connects the right hand upper and lower conduit sections. The conduits 16, 18 include an inner wall 30 and an outer wall 32, with the inner and outer walls 30, 32 being perforated such that hot air from the plenums 20, 22 passes therethrough. Generally, grain flowing along the inner wall 30 remains adjacent the inner wall 30 from the top of the upper conduit 16 to the bottom of the lower conduit 18, wherein the grain is discharged. Exposure to the hottest and driest air from the heat plenums 20, 22 from the inlet of the dryer 10 to the discharge of the dryer causes the grain moving along the inner wall 30 to be over-dried. Conversely, grain moving along the outer wall 32 may be under-dried since the air is cooler and has picked up moisture passing through the grain adjacent the inner wall 30. Thus, non-uniform drying occurs in this prior art stack dryer.

Figure 3:
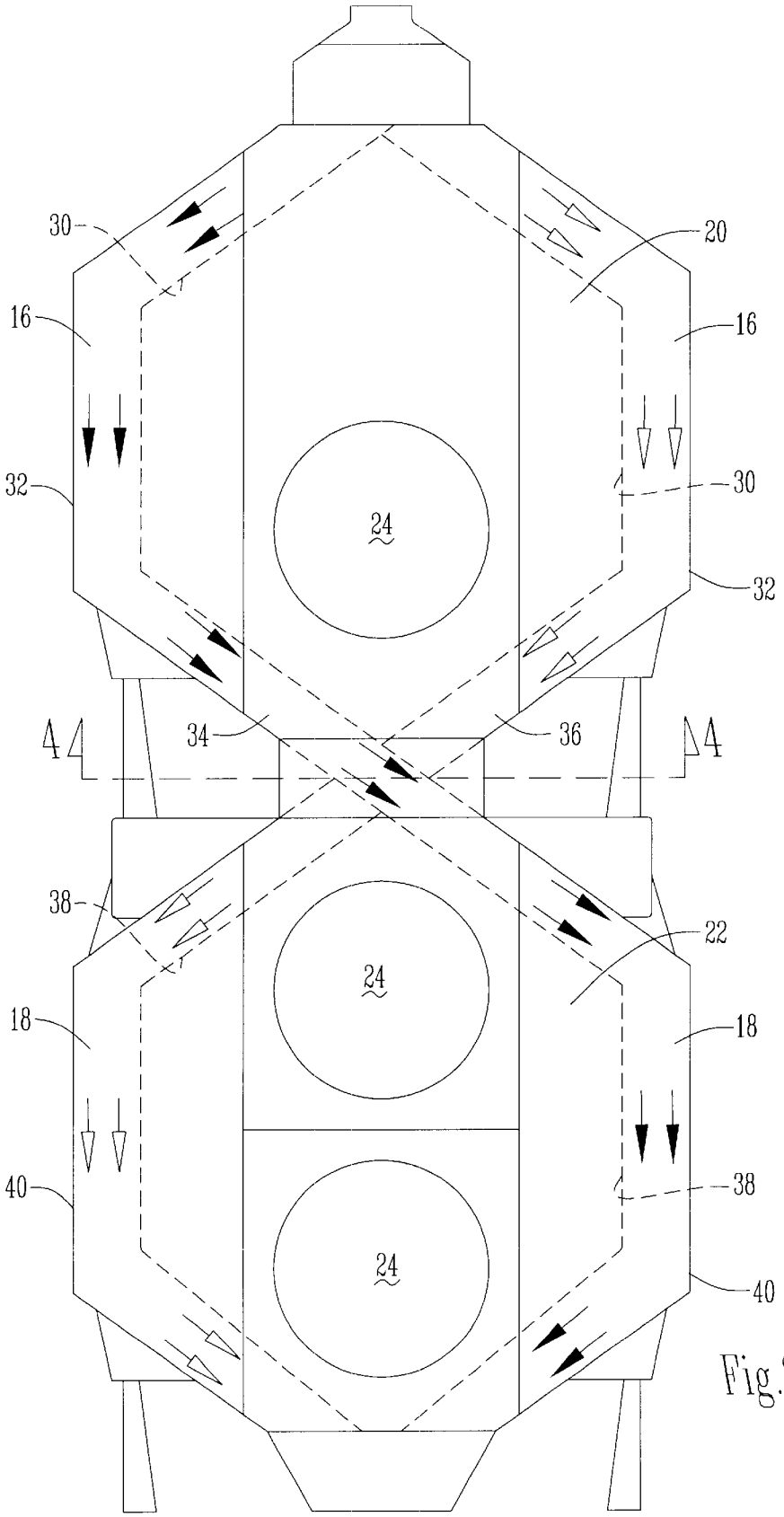
FIG. 3 is a sectional view showing the crossover conduits of the stack dryer of the present invention.
Figure 4:
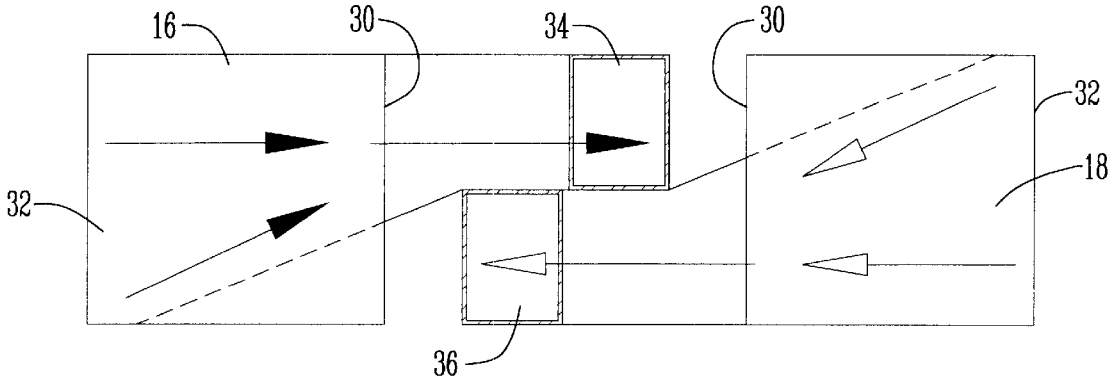
FIG. 4 is a sectional view taken along lines 4—4 of FIG. 3.

The present invention is directed towards the configuration of the upper and lower grain conduits 16, 18. In the present invention, the left hand and right hand transition conduit sections 26, 28 are removed and replaced with crossover conduit sections 34, 36. The conduits 16, 18 taper on each end of the crossover conduits 34, 36 such that the crossover conduits have approximately one-half the area of the upper and lower conduits. The crossover conduits 34, 36 pass through the vertical axis of the upper and lower plenums 20, 22, as best seen in FIG. 3. With this crossover construction, grain flowing along the inner wall 30 or outer wall 32 of the upper grain conduit 16 transitions to the outer wall 40 or inner wall 38, respectively, of the lower conduit 18. For example, grain flowing along the inner wall 30 of the upper conduit 16 passes through the crossover conduits 34 or 36 after which the grain is adjacent the outer wall 40 of the lower conduit 18. Similarly, the grain adjacent the outer wall 32 in the upper conduit 16 automatically is adjacent the inner wall 38 of the lower conduit 18 after passing through the crossover conduit 34, 36.

As hot air from the heat plenums 20, 22 passes through the grain in the conduits, the air temperature decreases and the air moisture increases. Accordingly, grain adjacent the outer wall 32 in the upper conduits 16 is exposed to cooler and moister air from the upper heat plenum 20, and then crosses over into the lower conduit adjacent the inner wall 38 thereof for exposure to the hotter and dryer air from the lower heat plenum 22. Similarly, grain adjacent the inner wall 30 in the upper conduit 18 is exposed to the hottest and driest air from the upper plenum 20 so as to be a hotter inner layer of grain, and then passes into the lower conduit 18, adjacent the outer wall 40 thereof so as to be the cooler outer layer. Thus, improved uniformity of drying is achieved with the crossover conduits of the present invention, by eliminating or minimizing the adverse effect of wind on one side of the dryer and by changing the exposure of the grain to the hottest air from the heat plenums as the grain crosses over from upper conduits 16 to the lower conduits 18.

The preferred embodiment of the present invention has been set forth in the drawings, specification, and although specific terms are employed, these are used in a generic or descriptive sense only and are not used for purposes of limitation. Changes in the form and proportion of parts as well as in the substitution of equivalents are contemplated as circumstances may suggest or render expedient without departing from the spirit and scope of the invention as further defined in the following claims.

What is claimed is:

1. A grain dryer, comprising:

first and second separate grain conduits each having upper and lower sections and a central crossover section;

an upper heat plenum between the upper sections;

a lower heat plenum between the lower sections;

wherein the crossover sections of each of the first and second grain conduits extend the respective conduits from one side of the upper heat plenum to an opposite side of the lower heat plenum.

2. The grain dryer of claim 1 wherein the first and second conduits each have opposite inner and outer sides, whereby grain adjacent the inner side of each upper section flows through the crossover sections so as to be adjacent the outer side of each lower section.

3. The grain dryer of claim 1 wherein the conduits have an open internal passageway.

4. A stack grain dryer, comprising an upper dryer having an upper heat plenum connected to a source of heated air and first and second upper grain conduits on opposite sides of the upper heat plenum;

a lower dryer having a lower heat plenum connected to a source of heated air and first and second lower grain conduits on opposite sides of the lower heat plenum;

the upper dryer being stacked upon the lower dryer so as to define a vertical axis through the upper and lower heat plenums;

a first crossover grain conduit section connecting the first upper conduit to the first lower conduit, and passing through the vertical axis; and a second crossover grain conduit section connecting the second upper conduit to the second lower conduit and passing through the vertical axis.

5. The stack grain dryer of claim 4 wherein the first upper and lower conduits are isolated from the second upper and lower conduits.

6. The stack grain dryer of claim 4 wherein the first and second upper and lower grain conduits each have opposite inner and outer sides, whereby grain adjacent the inner and outer sides of the upper grain conduits flow through the crossover grain conduit sections so as to be adjacent the outer and inner sides of the lower conduits, respectively.

7. A method of drying grain in a dryer having a heat plenum comprising:

extending upper sections of a pair of separate grain conduits along opposite sides of the heat plenum;

crossing the conduits over such that lower sections of the conduits extend along opposite sides of the heat plenum; and passing the grain through the grain conduits for drying with heat from the heat plenum.

8. The method of claim 7 wherein the grain flows through the conduit without encountering structural obstacles.

9. A method of drying grain in a dryer having a heat plenum having opposite first and second sides, comprising:

passing a first quantity of grain through a first grain conduit extending along the first side of the heat plenum and crossing over to the second side of the heat plenum;

passing a second quantity of grain through a second grain conduit extending along the second side of the heat plenum and crossing over to the first side of the heat plenum; and maintaining the first and second quantities of grain separate from one another.

* * * * *

UNITED STATES PATENT AND TRADEMARK OFFICE

CERTIFICATE OF CORRECTION

PATENT NO. : 6,360,451 B1
DATED : March 26, 2002
INVENTOR(S) : John A. Hanig

It is certified that error appears in the above-identified patent and that said Letters Patent is hereby corrected as shown below:

Column 3,
Line 50, after the word "conduits" insert the following: -- are isolated from one another and --.

Column 4,
Line 7, strike the word "and" (first occurrence).
Line 20, after the word "axis" and before the period insert the following: -- and the first and second crossover grain conduit sections being isolated from one another --.
Line 36, strike the word "and".
Line 38, after the word "plenum" and before the period insert the following: -- and maintaining the grain in the respective conduits during drying --.

Signed and Sealed this

First Day of October, 2002

*Attest:*

*Attesting Officer*

JAMES E. ROGAN
*Director of the United States Patent and Trademark Office*